US006149021A

United States Patent [19]

Beaulieu

[11] Patent Number: 6,149,021

[45] Date of Patent: Nov. 21, 2000

[54] FOLDING TRUSS MEMBER FOR A DISPLAY

[75] Inventor: Bryan J. Beaulieu, Burnsville, Minn.

[73] Assignee: Skyline Displays, Inc., Eagan, Minn.

[21] Appl. No.: 09/151,721

[22] Filed: Sep. 11, 1998

Related U.S. Application Data

[60] Provisional application No. 60/058,779, Sep. 12, 1997.

[51] Int. Cl.[7] ..... A47B 43/00; E04H 12/18

[52] U.S. Cl. ..... 211/201; 52/646

[58] Field of Search ..... 211/201, 195; 52/109, 645, 646, 652.1, 690–692, 79.5

[56] References Cited

U.S. PATENT DOCUMENTS

| | | | |
|---|---|---|---|
| 925,413 | 6/1909 | Addison et al. | 211/201 |
| 1,545,148 | 7/1925 | Lindau | 52/646 |
| 1,651,032 | 11/1927 | Macomber | 52/692 |
| 1,680,976 | 8/1928 | Frease | 52/692 |
| 2,985,316 | 5/1961 | Ruhnke | 211/201 |
| 3,474,579 | 10/1969 | Kieser | 52/646 |
| 4,655,022 | 4/1987 | Natori | 52/646 |
| 4,658,560 | 4/1987 | Beaulieu | 52/646 |
| 4,791,761 | 12/1988 | Goudie | 52/646 |
| 5,230,196 | 7/1993 | Zeigler | 52/646 |
| 5,234,116 | 8/1993 | Kristinssonet al. | 211/201 |
| 5,267,424 | 12/1993 | Douglas | 52/646 |
| 5,351,843 | 10/1994 | Wichman et al. | 211/195 |
| 5,356,234 | 10/1994 | Vangool | 52/646 |
| 5,822,945 | 10/1998 | Muller | 52/646 |
| 5,826,397 | 10/1998 | Armold | 52/646 |

FOREIGN PATENT DOCUMENTS

| | | | |
|---|---|---|---|
| 600937 | of 1960 | Canada | 52/646 |
| 1495511 | 9/1967 | France | 52/646 |
| 279201 | 11/1964 | Switzerland | 52/646 |

*Primary Examiner*—Daniel P. Stodola
*Assistant Examiner*—Jennifer E. Novosad
*Attorney, Agent, or Firm*—Larkin, Hoffman, Daly & Lindgren, Ltd.; John F. Klos

[57] ABSTRACT

A portable display system having a plurality of truss members and a plurality of connection structures for interconnecting the plurality of truss members to form the display structure. Each of the plurality of truss members include at least a pair of brace members, each brace member having a pair of spaced apart, generally parallel frame tubular members rigidly and non-rotatably interconnected by a plurality of fixed wire members. Each tubular member includes a contiguous exterior surface, and each of said plurality of fixed wire members are secured to both contiguous exterior surfaces of the tubular members. A pair of pivoting wire member are each pivotally secured to both brace members, so that each of the plurality of truss members are capable of being placed in a deployed condition from a flattened condition by pivoting the first and second pivoting wire members relative to the first and second brace members.

19 Claims, 4 Drawing Sheets

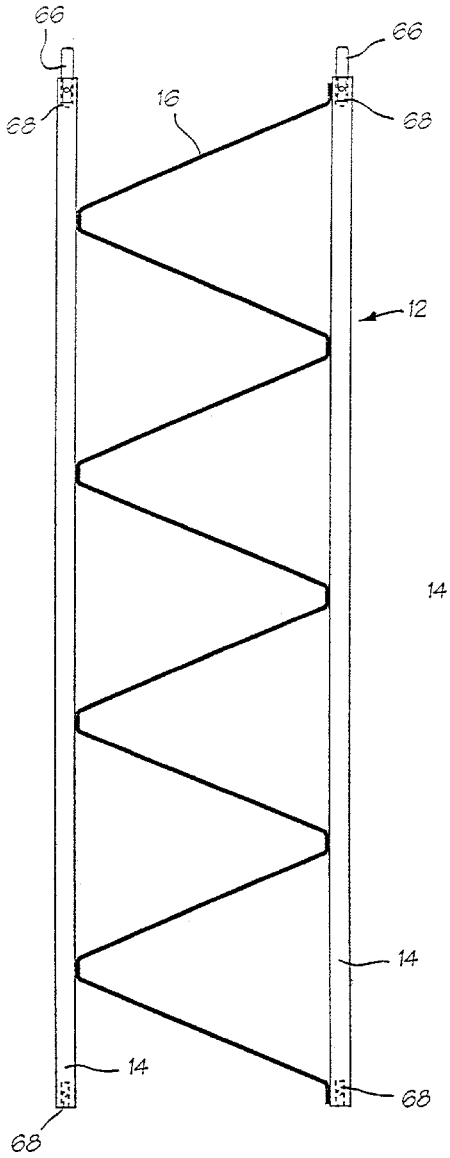
Figure 1
Figure 2
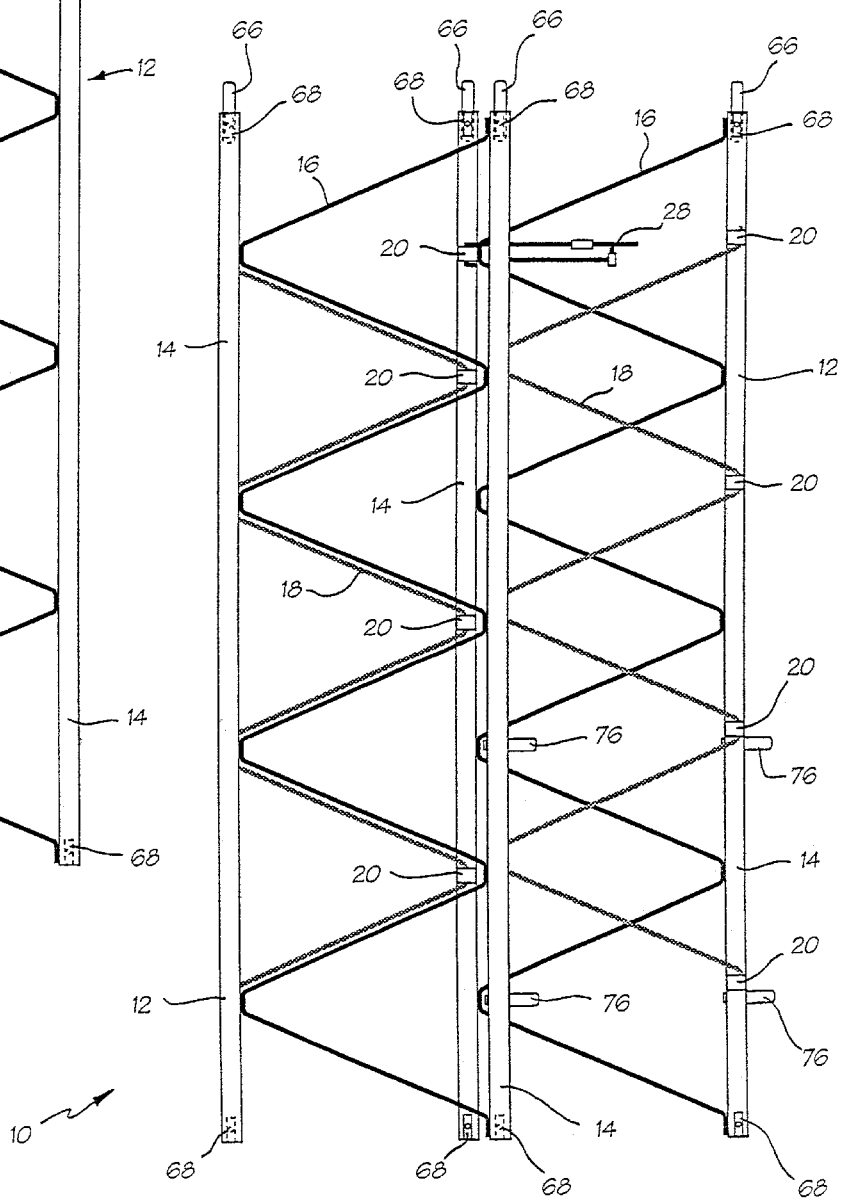

Figure 3
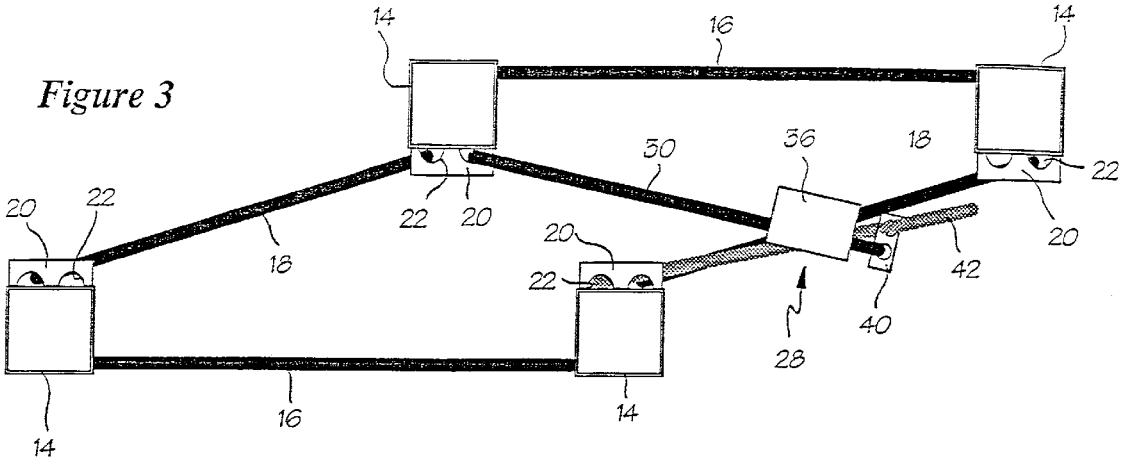
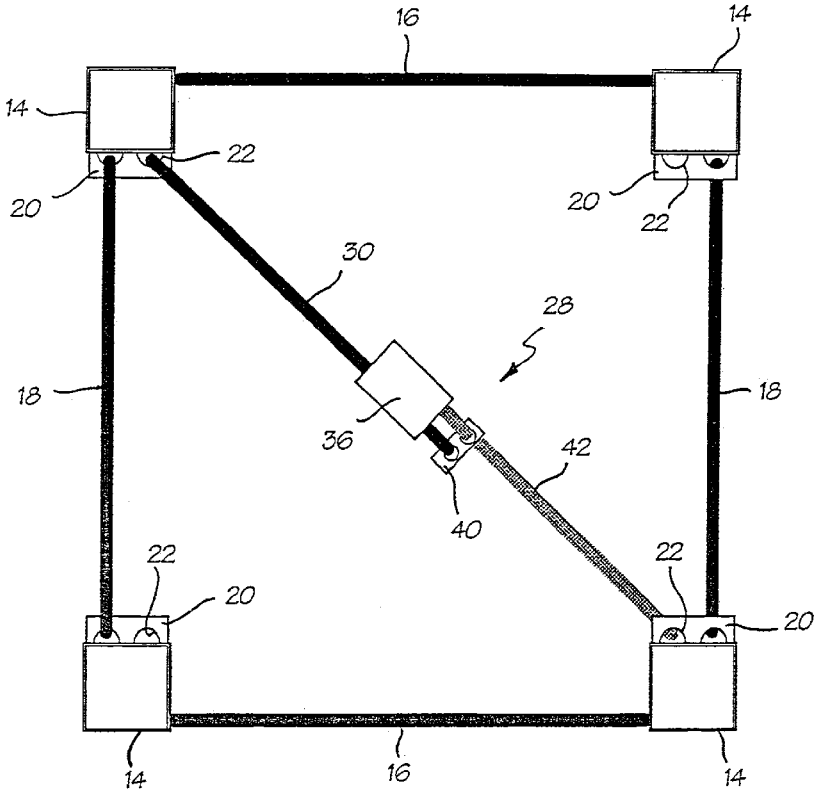
Figure 4

FOLDING TRUSS MEMBER FOR A DISPLAY

CROSS REFERENCE TO RELATED APPLICATIONS

This application claims the benefit of priority pursuant to 35 USC §119(e)(1) from the provisional patent application filed pursuant to 35 USC §111(b): as Ser. No. 60/058,779 on September 12, 1997.

BACKGROUND OF THE INVENTION

1. Field of the Invention

The present invention relates to trusses, columns, and headers for presentation displays and booths of the type traditionally used at conventions and exhibits, and particularly to a portable folding truss system having interconnectable elements.

2. Brief Description of the Prior Art

Various types of folding truss members are known for commercial displays, with designs having triangular cross sections predominating. However, those designs generally employ at least one common vertex which defines a conventional hinge assembly between adjacent planar segments, and therefore mitigates against the use of that hinge member for mounting or support because the alternating hinge elements rotate relative to one another in opposing directions as the truss is folded and unfolded.

SUMMARY OF THE INVENTION

The present invention is a folding truss system for portable displays. A compact and efficiently assembled and disassembled display is provided by the invention. The truss system is formed from a plurality of interconnected truss members. Each truss member includes a pair of generally planar brace members which are interconnected by a pair of pivoting structures. Each brace member is pivotally secured to at least one pivoting structure. Each truss member further includes a locking structure for maintaining the truss member in its assembled state. Individual truss members may be linked to adjacent truss members through a coupling or other connection to form a display structure.

BRIEF DESCRIPTION OF THE DRAWINGS

FIG. 1 is a front elevation view of one of the brace elements of the folding truss system of this invention;

FIG. 2 is a front elevation view of a pair of the brace elements of FIG. 1 pivotably and hingedly interconnected to form a rectangular folding truss, shown in the fully folded configuration, as an illustrative example of the folding truss system of this invention;

FIG. 3 is a top partially cut-away view of the folded truss of FIG. 2 in the partially unfolded configuration showing the parallel brace elements closely proximate to one another and the locking arm assembly partially folded;

FIG. 4 is a top partially cut-away view of the truss of FIG. 3 showing the parallel brace elements unfolded to form a rectangular truss member and the locking arm assembly extended to its locked position;

DETAILED DESCRIPTION OF THE PREFERRED EMBODIMENTS

Figure 6:
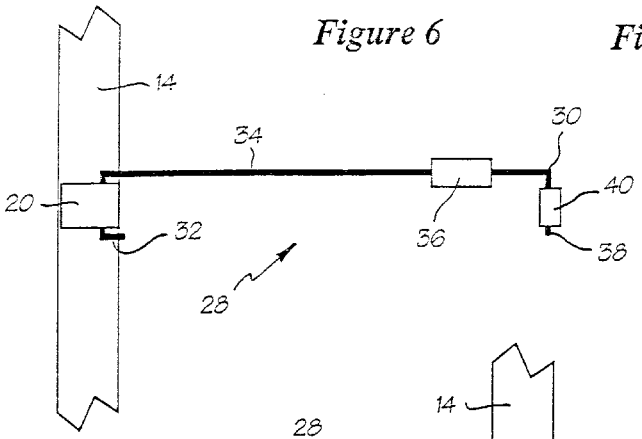
FIG. 6 is a side elevation view of the first arm of the locking arm assembly with the fulcrum block and U-shaped locking clasp mounted thereon.
Figure 5:
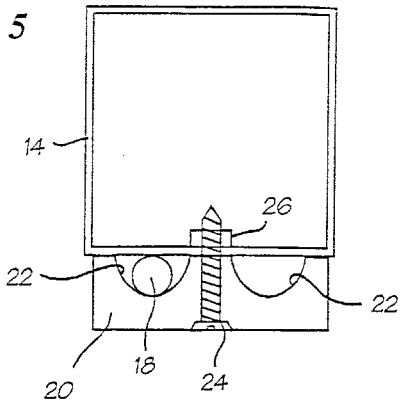
FIG. 5 is a diagrammatic top view of one vertical frame member showing a pivot assembly mounted thereon and hinged wire trapped element therein.
Figure 7:
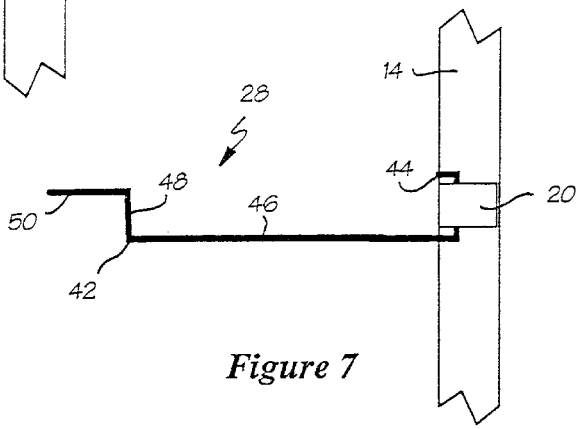
FIG. 7 is a side elevation view of the second arm of the locking arm assembly showing the Z-shape configuration of the locking extension.

The folding truss system of this invention is illustrated in FIGS. 1–16, and the invention is referenced generally therein by the numeral 10.

Referring generally to FIGS. 1–16, one illustrative and representative example of the truss system 10 of this invention and its alternate embodiments is shown, in which the operating configuration of the truss members 10 is a generally rectangular or square shape when folded to a fully upright, open, or expanded position. It will be readily appreciated by those skilled in the art that truss systems 10 having polygonal configurations other than a square or rectangle can be constructed using the concepts and teachings disclosed herein, and in particular triangular, hexagonal, octagonal, and other configurations, however a square or rectangular configuration has proven both practical and particularly well-suited for the applications described herein and to achieve some of the particular features and advantages discussed, and therefore in some limited respects preferable to other configurations.

Referring particularly to FIG. 1 and 2, it may be seen that the truss member 10 is constructed from a pair of brace members 12, each having a pair of spaced apart, generally parallel tubular frame members 14 extending the length of height of the brace member 12, interconnected by a serpentine or convoluted stationary or fixed wire member 16. The fixed wire member 16 is preferably welded or securely attached or affixed to the two frame members 14 to maintain the generally planar configuration of the brace member 12 and provide structural integrity in a direction transverse to the longitudinal axis of the brace member 12. The fixed wire member 16 may be a single wire or may be comprised of several individual wires secured between the brace members 12. Any relatively thin and elongate material may be used to form the fixed wire member 16, including metal wire, laser cut metal forms, stamped metal forms, etc. Depending upon the particular application as a header, column, or other structural member in a display or booth, the brace member may have an overall length from just a few to many feet. Standard modular lengths of approximately 4', 6', 8', 12' and so forth have proven suitable, with the actual physical lengths being decreased slightly to accommodate coupling means of various design as more fully described in this specification for use in joining a plurality of truss members 10 either longitudinally aligned, or at generally orthogonal or perpendicular angles relative to one another.

Referring to FIGS. 2–5, the truss member 10 is constructed from a pair of the brace members 12 hingedly joined by a pair of substantially planar convoluted or serpentine pivoting wire members 18, shown in a lighter shade in FIG. 2 for clarity with the overlapping fixed wire members 16.

Each of the pivoting wire members 18 is hingedly mounted to the corresponding frame members 14 of the brace members 12 using a plurality of hinge block members 20 defining one or more semi-circular channels 22 which receive and engage a generally planar or flat segment of the pivoting wire members 18 therein, the hinge block members 20 permitting the aligned and trapped segments of the pivoting wire members 18 to pivot or rotate substantially freely therein, or if desired, applying slight frictional pressure resisting rotation and maintaining longitudinal alignment. Each hinge block member 20 is mounted on the corresponding frame member 14 using a fastener 24 extending through the hinge block member 20 and into a backing element 26 within the hollow interior region of the frame member 14. Threaded fasteners 24 have proven suitable for permitting removal of the hinge block members 20 and pivoting wire members 18 for disassembly of the truss member 10, or the hinge block members 20 may be securely or permanently attached to the frame members 14 such as by welding, adhesive bonding, riveting, or other means to prevent non-destructive disassembly of the truss member 10. As will be readily appreciated by those of skill in the art, other conventional hinge assemblies, fasteners 24, or mounting means may be employed as desired depending upon the particular application and other design features or structural considerations for that embodiment.

It will also be readily appreciated that the number, angle, uniformity, and spacing of the curves of both the fixed wire members 16 and pivoting wire members 18—as well as the longitudinal stagger between the adjacent, proximate, or overlapping curves of each fixed wire member 16 and pivoting wire member 18—will be dictated by several considerations, including the necessity for clearance or alignment of the structural elements and other components when folded as in FIG. 2 and during unfolding as in FIG. 3, the structural integrity and weight bearing capacity of the truss member 10 in either the longitudinal or transverse directions, the aesthetic characteristics of the truss member 10 when assembled and set up for use, and ease in handling or carrying the truss member 10 when folded.

Referring further to FIGS. 2–4 and 6–8, it may be seen that the truss member 10 includes one or more locking arm assemblies 28 spaced suitably along the truss member 10 and mounted at each end to diagonally opposing frame members 14 using similar hinge block members 20 to maintain the truss member 10 in a completely unfolded and upright configuration once unfolded from the flat configuration. Locking arm assemblies 28 provide structural support to the deployed truss member 10 by rigidly securing at least a pair of brace members 12.

In one embodiment as shown in FIGS. 3–4, 6, and 7, the locking arm assembly 28 includes a first locking arm 30 defining a generally C-shape having one leg 32 received and engaged within a hinge block member 20, an elongated intermediate segment 34, a U-shaped locking clasp 36 fixedly mounted on the intermediate segment 34 proximate to the distal end thereof, and a depending leg 38 received within and securely attached to a fulcrum block 40 or similar hinge member. The second locking arm 42 has a generally Z-shape configuration including a leg 44 received and engaged within a hinge block member 20, an intermediate segment 46, a spacer segment 48 which is rotatably received within the fulcrum block 40 generally parallel with the depending leg 38 of the first locking arm 30, and a locking extension 50 which is frictionally and engagingly received within the U-shaped locking clasp 36 when the second locking arm 42 pivots into parallel alignment with the first locking arm 30 as shown particularly in FIG. 4.

It should be noted that in FIGS. 3 and 4, portions of the pivoting wire members 18 are shown for orientation and alignment purposes only. The pivoting wire members 18 extend at acute angles upwardly and downwardly relative to the plane of FIGS. 3 and 4, whereas the locking arms 30, 42 are generally parallel with that plane. As such, the pivoting wire members 18 are not engaged within the adjacent hinge block members 20 to which the locking arms 30, 42 are attached, but instead are disposed above or below those hinge block members 20.

Figure 8:
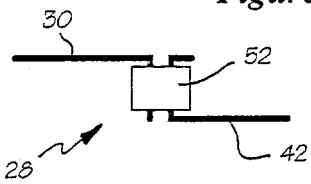
FIG. 8 is a an alternate embodiment of the locking assembly in which the locking arms are slidably and engagingly received within bores defined by the manual locking and fulcrum block.

Referring to FIG. 8, an alternate locking arm assembly 28 is shown, in which one or both opposing locking arms 30, 42 are slidably and engagingly received within a coupler 52 when those locking arms 30, 42 are pivoted into generally parallel alignment with one another within the interior of the truss member 10.

Figure 9:
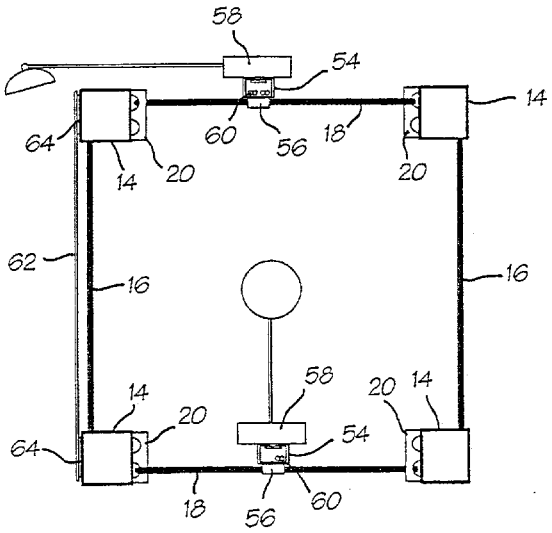
FIG. 9 is an end view of the assembled truss member having a face plate and lights attached.

Referring to FIG. 9, a truss member 10 is shown from above (if in the vertical orientation) or end view (if in the horizontal orientation) for use as a column (if vertical) or header (if horizontal). A U-shaped channel 54 may be attached to the interior or exterior side of the pivoting wire members 18 using a plurality of clips 56 or similar fastening or mounting members, the U-shaped channel 54 being used to mount various components or fixtures such as lighting elements 58, as well as to receive, organize, route, and hide wiring 60 for such purposes as the lighting elements 58, power supplies, or data or other communications.

Cover plates 62 may be attached to one or more faces of the truss member 10 in any suitable manner, for example using flexible magnetic film 64, hook-and-loop fasteners, adhesive, or other traditional fasteners or mounting means. In the case of a rectangular truss member 10 shown herein for illustrative purposes, the generally rectangular cross section of the frame members 14 provide several parallel coplanar surfaces for mounting the cover plates 62. The cover plates 62 may constitute paper, card stock, or synthetic film signage, reinforced or foamcore boards, double- or single-faced corrugated plastic sheet material, or building materials such as wood, metal, or composites designed to enhance structural integrity, weight-bearing capacity, or provide a desired aesthetic image. To reduce weight, such materials may be perforated or laser-cut to a desired pattern. It will be readily appreciated that such structural materials will normally be mounted using heavy-duty fasteners such as screws, bolts, or the like. Light-weight transparent materials may similarly be used for the cover plates 62 with lighting elements 58 disposed within the interior of the truss member 10 for back-lighting. When used in the horizontal or transverse mode for weight-bearing, it may be appreciated that orienting the brace members 12 in the vertical direction provides enhanced structural integrity and support compared with orienting the pivoting wire members 16 in the vertical or weight-bearing direction.

Figure 10:
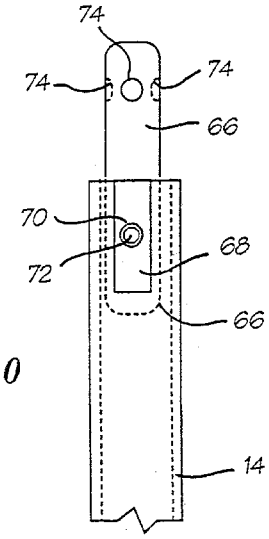
FIG. 10 is a side elevation view of one of the exposed ends of a frame member showing a longitudinal connecting element mounted therein.

Referring to FIGS. 1, 2, and 10, it may be seen that aligned brace members 12 of two truss members 10 may be axially coupled using connecting elements 66 slidably and engagingly received within the open ends of the hollow tubular frame members 14. Each end of the corresponding frame members 14 include a mounting block 68 fixedly attached to the frame member 14 and defining a threaded aperture 70 extending through the mounting block 68 and frame member 14, an alien or hex nut 72 being received within the threaded aperture 70 and engaging recesses 74 in the connecting elements 66.

Referring again to FIG. 2, it may be appreciated that transverse connecting members 76 (similar to longitudinal connecting members 66 but attached through apertures defined by the frame members 14 and secured by nuts or suitable fasteners) are positioned so as to engage the open ends of a like truss member 10 at a generally parallel orientation with the unfolded truss member 10. Those transverse connecting members 76 fold generally flat or parallel with the planes of the corresponding brace member 12 when the truss member 10 is folded to its flat or completely folded configuration, as shown in FIG. 2.

Figure 11:
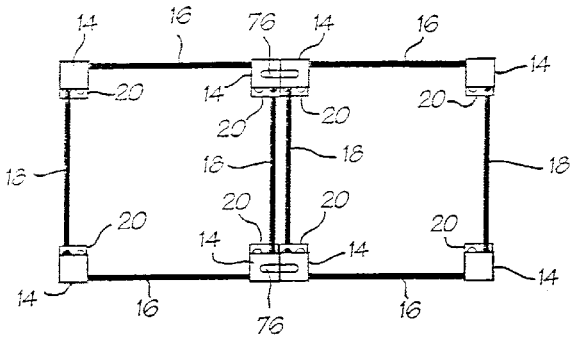
FIG. 11 is a top view of two truss members connected in parallel configuration to form an enlarged support column.
Figure 12:
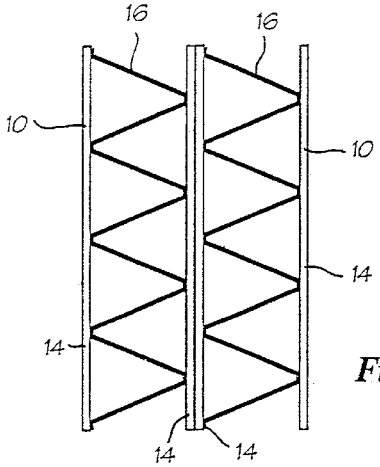
FIG. 12 is a side elevation view of two truss members connected in parallel configuration to form an enlarged support column.
Figure 17:
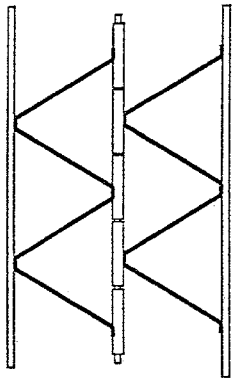
Figure 17 (Prior Art)
FIG. 17 is a diagrammatic view of a two elements of a prior art folding truss design hingedly connected at a common pivot axis.

Referring to FIGS. 11 and 12, it may be seen that two truss members 10 may be mounted in parallel with one another using conventional fastening members to form an enlarged super-column.

Figure 13:
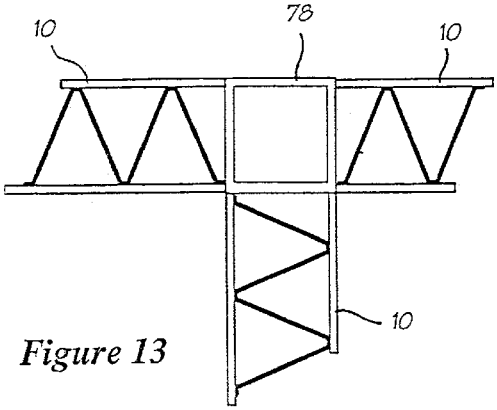
FIG. 13 is a side elevation view of three truss members connected by a coupling cube member to form a T-shaped configuration.
Figure 14:
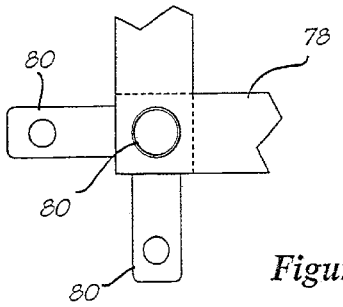
FIG. 14 is a partially broken away detail view of the comer of a coupling cube member showing three longitudinal connecting elements extending orthogonally therefrom.

Referring to FIGS. 13 and 14, a coupling cube 78 having a plurality of connecting members 80 extending in perpendicular or orthogonal relation to one another from the comers of the coupling cube 78 may be utilized to attach several truss members 10 is L-shaped, T-shaped, or X-Y-X-axis configurations as desired to assembly large and complex display booths, header and column configurations, and ceiling structures.

Figure 16:
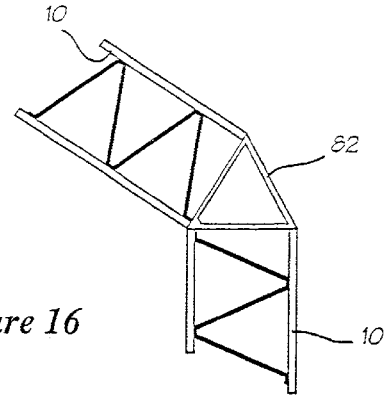
FIG. 16 is a diagrammatic view of a truss member of this invention having telescoping longitudinal extensions received within the frame members.
Figure 15:
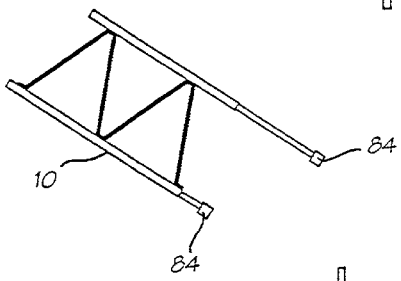
FIG. 15 is a diagrammatic view of a first truss member of this invention mounted at an angle on the end of a like truss member using an angular connecting member.

Referring to FIG. 15, angular coupling structures 82 may be utilized to connect truss members 10 at angles other than perpendicular, and as shown in FIG. 16, telescoping extension arms 84 may be received and clamped within the open ends of the frame members 14 and adjusted relative to one another to accommodate angular connections.

While the preferred embodiments of the above truss member 10 and its method of fabrication or manufacture 10 have been described in detail with reference to the attached drawings Figures, it is understood that various changes, modifications, and adaptations may be made in the truss member without departing from the spirit and scope of the invention taught herein.

I claim:

1. A portable display system comprising:

a plurality of truss members; and a plurality of connection structures for interconnecting the plurality of truss members to form the display system, each of said plurality of truss members including a first and second brace member, each brace member having a pair of spaced apart, generally parallel tubular frame members rigidly and non-rotatably interconnected by a plurality of fixed wire members, each tubular frame member having a contiguous exterior surface, each of said plurality of fixed wire members associated with each said brace member being rigidly and non-rotatably secured to both contiguous surfaces of the tubular members of the respective brace member, and a first and second pivoting wire member each pivotally secured to one of the frame members of said first brace member and to an adjacent frame member of said second brace member, each of the plurality of truss members capable of being placed in a deployed condition from a flattened condition by pivoting the first and second pivoting wire members relative to the first and second brace members.

2. A portable display system according to claim 1 wherein each of the plurality of fixed wire members is formed as a portion of a single serpentine wire.

3. A portable display system according to claim 1 wherein the first and second pivoting wire members are substantially planar.

4. A portable display system according to claim 3 wherein each of the pivoting wire members is a single serpentine wire.

5. A portable display system according to claim 1 further comprising:

a locking assembly for securing the brace members relative to each other in the deployed condition.

6. A portable display system according to claim 5 wherein the locking assembly includes a first locking arm and a second locking arm, said first locking arm secured to one of the brace members and said second locking arm secured to the other brace member, said first and second locking arms interacting within the truss member.

7. A portable display system according to claim 1 wherein the first or second pivoting wire member is secured to a corresponding brace member with a plurality of hinge block members defining one or more semicircular channels which receive and engage a segment of the pivoting wire member therein.

8. A portable display system according to claim 1 wherein each of the plurality of connection structures is secured to a corresponding brace member.

9. A portable display system comprising:

a plurality of truss members; and a plurality of connection structures for interconnecting the plurality of truss members to form the display system, each of said plurality of truss members including a first and second brace member, each of said first and second brace members having a pair of spaced apart frame members, each of said pair of frame members of the respective brace member having a contiguous exterior surface and being rigidly and nonrotatably coupled together by a fixed wire member secured to the contiguous surfaces of the frame members in each respective brace member, and a first and second pivoting wire member each pivotally secured to one of the frame members of said first brace member and to an adjacent frame member of said second brace member.

10. A portable display system according to claim 3 wherein the frame members are tubular.

11. A portable display system according to claim 9 wherein the fixed wire member is a single serpentine wire.

12. A portable display system according to claim 9 wherein the frame members associated with each brace member are substantially parallel to each other.

13. A portable display system according to claim 12 wherein at least one of the truss members is rectangular in form in the deployed condition.

14. A portable display system according to claim 9 wherein each of the first and second pivoting wire members are substantially planar.

15. A portable display system according to claim 14 wherein the pivoting wire members are each a single serpentine wire.

16. A portable display system according to claim 9 further comprising:

a locking assembly for securing the brace members relative to each other in the deployed condition.

17. A portable display system according to claim 9 wherein the locking assembly includes a first locking arm and a second locking arm, said first locking arm secured. to a first brace member and said second locking arm secured to a second brace member, said first and second locking arm interacting within the truss member.

18. A portable display system according to claim 9 wherein the first or second pivoting wire member is secured to a predetermined brace member with a plurality of hinge block members defining one or more semicircular channels which receive and engage a segment of the pivoting wire member therein.

19. A portable display system according to claim 9 wherein a portion of each of the plurality of connection structures is secured to a predetermined brace member.

* * * * *